US008276949B2

(12) United States Patent
Akizuki et al.

(10) Patent No.: US 8,276,949 B2
(45) Date of Patent: Oct. 2, 2012

(54) VEHICLE DOOR LOCK DEVICE

(75) Inventors: Ryujiro Akizuki, Novi, MI (US); Takashi Nishio, Kariya (JP); Nobuko Watanabe, Anjo (JP); Yasuhiko Sono, Hekinan (JP); Kazunori Kojima, Aichi-ken (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 0 days.

(21) Appl. No.: 13/113,388

(22) Filed: May 23, 2011

(65) Prior Publication Data

US 2011/0254287 A1 Oct. 20, 2011

Related U.S. Application Data

(63) Continuation of application No. PCT/JP2011/054907, filed on Mar. 3, 2011.

(30) Foreign Application Priority Data

Mar. 24, 2010 (JP) ..... 2010-67897
Nov. 10, 2010 (JP) ..... 2010-251512

(51) Int. Cl.
*E05C 3/06* (2006.01)
*E05C 3/16* (2006.01)

(52) U.S. Cl. ..... 292/201; 292/216; 292/DIG. 23

(58) Field of Classification Search ..... 292/201, 292/216, DIG. 23
See application file for complete search history.

(56) References Cited

U.S. PATENT DOCUMENTS

| | | | | |
|---|---|---|---|---|
| 6,382,686 | B1 * | 5/2002 | Ishigaki et al. | 292/201 |
| 7,021,681 | B2 * | 4/2006 | Hayakawa et al. | 292/216 |
| 7,055,872 | B2 * | 6/2006 | Hayakawa et al. | 292/216 |
| 7,441,815 | B2 * | 10/2008 | Umino | 292/216 |
| 7,559,586 | B2 | 7/2009 | Fukunaga et al. | |
| 7,568,741 | B2 * | 8/2009 | Odahara | 292/216 |
| 7,621,571 | B2 * | 11/2009 | Umino | 292/216 |
| 2003/0234544 | A1 * | 12/2003 | Jankowski et al. | 292/220 |
| 2004/0036298 | A1 * | 2/2004 | Hayakawa et al. | 292/216 |
| 2007/0075552 | A1 * | 4/2007 | Hayakawa et al. | 292/216 |
| 2010/0171321 | A1 * | 7/2010 | Akizuki et al. | 292/200 |
| 2010/0327609 | A1 * | 12/2010 | Akizuki et al. | 292/85 |
| 2011/0162419 | A1 * | 7/2011 | Akizuki et al. | 70/141 |

FOREIGN PATENT DOCUMENTS

| | | |
|---|---|---|
| JP | 2001-173287 A | 6/2001 |
| JP | 2002-220961 A | 8/2002 |
| JP | 2004-44360 A | 2/2004 |
| JP | 2006-233507 A | 9/2006 |

* cited by examiner

*Primary Examiner* — Carlos Lugo
*Assistant Examiner* — Alyson M Merlino
(74) *Attorney, Agent, or Firm* — Buchanan Ingersoll & Rooney PC

(57) ABSTRACT

A vehicle door lock device includes a latch mechanism having a lift lever and further includes an inside open lever, an outside open lever, an open link and an active lever. A spring is interposed between the outside open lever and the open link. In the housing, provided is an unlocked state holding guide for holding the open link in an unlocked state when the active lever is in an unlock position and when the outside open lever rotates. In the active lever, provided is a locked state holding guide for holding the open link in a locked state when the active lever is in a lock position and when the outside open lever rotates. This construction enables reduction of the number of components and construction of the device in a simple and inexpensive manner.

8 Claims, 11 Drawing Sheets

VEHICLE DOOR LOCK DEVICE

CROSS-REFERENCE TO RELATED APPLICATION

The disclosures of Japanese Patent Application No. 2010-067897 filed on Mar. 24,2010, and Japanese Patent Application No. 2010-251512 filed on Nov. 10, 2010 including the specification, drawings and abstract are incorporated herein by reference in its entirety.

FIELD OF THE INVENTION

The present invention relates to a vehicle door lock device, capable of holding a door of a vehicle in a closed state with respect to a body of the vehicle and capable of bringing the door into a locked state.

BACKGROUND OF THE INVENTION

As an example of vehicle door lock device, a vehicle door lock device includes a latch mechanism which is mounted to a door together with a housing, as well as an open lever, an open link, and an active lever which are mounted to the housing. This type of door lock device is described in Japanese Patent Application Publication No. 2006-233507, for example. The latch mechanism is capable of holding the door in a closed state with respect to a body of the vehicle. The latch mechanism includes a latch capable of being engaged with and disengaged from a striker mounted to the body and a lift lever capable of maintaining and releasing the engaged state of the latch with respect to the striker. The open lever is actuated along with a door opening operation of a door handle provided inside or outside the door.

The open link is disposed between the open lever and the lift lever. The open link switches an operation state between an unlocked state and locked state of the vehicle door lock device. In unlocked state, an operation in a door opening direction of the open lever along with the door opening operation of the door handle is transmitted to the lift lever. In locked state, the operation in the door opening direction of the open lever is not transmitted to the lift lever. The active lever is a lock operation lever for switching the operation state of the open link to the unlocked state or the locked state. A position of the active lever is switched from an unlock position to a lock position by a locking operation of a lock/unlock operation member to bring the open link into the locked state, and is switched from the lock position to the unlock position by an unlocking operation of the lock/unlock operation member to bring the open link into the unlocked state.

According to the vehicle door lock device described in Japanese Patent Application Publication No. 2006-233507, the active lever includes a main lever rotatably mounted to the housing and associated with the lock/unlock operation member, a sub lever rotatably mounted relatively to the main lever and associated with the open link, and a spring interposed between the main lever and the sub lever and biasing the sub lever toward a predetermined position with respect to the main lever. In the door-locked state (in a state where the door is locked), when the door handle and the lock/unlock operation member are operated at a time and a panic state occurs, the spring deforms itself elastically to permit (guarantee) movement of the main lever to an unlock position and also permit return of the open link to an initial position (return position). Thus, smooth switching into the door-unlocked state (in a state where the door is locked) can be achieved.

SUMMARY OF THE INVENTION

In the vehicle door lock device described in Japanese Patent Application Publication No. 2006-233507, functional requirements are satisfied because it can properly handle even a panic state as mentioned above. However, the active lever consists of three components, i.e., the main lever, the sub lever, and the spring. Thus, from the active lever to the open link, four components are required. Accordingly, simplification of the construction (reduction of the number of components) is desired.

According to the present invention devised to deal with the above requirement, a vehicle door lock device is provided comprising a latch mechanism being capable of holding a door of a vehicle in a closed state with respect to a body of the vehicle and adapted to be mounted to said door together with a housing; an inside open lever rotatably mounted to said housing and adapted to be actuated for rotation from an initial position to an operating position along with a door opening operation of an inside door handle provided inside said door; an outside open lever rotatably mounted to said housing and adapted to be actuated for rotation from an initial position to an operating position along with a door opening operation of an outside door handle provided outside said door; an open link tiltably mounted to a connecting portion provided in said outside open lever by a predetermined amount, said connecting portion being adapted to be displaced along with rotation of said outside open lever, said open link having a pushing portion capable of engaging an engaging portion of a lift lever provided in said latch mechanism, said open link being pushed from an initial position toward said lift lever when said inside open lever is actuated for rotation from the initial position to the operating position or when said outside open lever is actuated for rotation from the initial position to the operating position; an active lever rotatably mounted to said housing and adapted to be switched by a locking operation of a lock/unlock operation member from an unlock position to a lock position to bring said open link into a locked state and switched by an unlocking operation of said lock/unlock operation member from the lock position to the unlock position to bring said open link into an unlocked state; a spring interposed between said outside open lever and said open link, the spring biasing said open link toward the unlocked state and causing the open link to be held relatively movably with respect to said lift lever to permit return of the open link to the initial position; an unlocked state holding guide for holding said open link in the unlocked state when said active lever is in the unlock position and when said outside open lever rotates between the initial position and the operating position; a locked state holding guide for holding said open link in the locked state when said active lever is in the lock position and when said outside open lever rotates between the initial position and the operating position; and a pushing arm portion provided in said active lever, said pushing arm portion being configured that when said active lever is in the unlock position, said pushing arm portion engages with said open link which is in the unlocked state so that said open link tilts by switching a position of said active lever from the unlock position to the lock position, and said pushing arm portion is disengageable from said open link which is in the locked state to permit the movement of the open link into the unlocked state.

In this case, a plane of rotation of a main portion of the lift lever and a plane of tilting of a main portion of the open link may be disposed in parallel with each other, a pushing leg portion may be provided in the lift lever, a receptor portion may be provided in the open link, and the lift lever may be disposed in a manner that the pushing leg portion of the lift lever is capable of pushing the receptor portion of the open link when the door which is in the state where the active lever is in the lock position and the outside open lever is in the initial position is closed from its opened state.

A pushing arm portion may be provided in the inside open lever, a receptor portion may be provided in the active lever, and the inside open lever may be disposed in a manner that the pushing arm portion thereof is capable of pushing the receptor portion of the active lever when the inside door handle is operated for opening said door which is closed and in the state where the active lever is in the lock position and the inside open lever is in the initial position.

In the vehicle door lock device according to the present invention, the spring interposed between the outside open lever and the open link biases the open link toward the unlocked state and causes the open link to be held movably relatively with respect to the lift lever so as to permit return of the open link to the initial position. Further, the pushing arm portion of the active lever is disengageable from the open link to permit movement of the open link from the locked state to the unlocked state. Therefore, in the door-locked state (in a state where the door is locked), when the door handle and the lock/unlock operation member are operated at a time and a panic state occurs, the open link is held movably relatively with respect to the lift lever to permit its return to the initial position. Thus, even in the panic state as mentioned above, by returning the outside open lever to the initial position, the open link returns to the initial position while coming into the unlocked state, and thus smooth switching into the door-unlocked state (in a state where the door is unlocked) can be achieved.

In the vehicle door lock device according to the present invention, when the panic state occurs as mentioned above, the spring interposed between the outside open lever and the open link functions as described above. This makes it unnecessary to interpose a spring in the active lever itself and makes it possible to constitute the active lever with a single member. As a result, components from the active lever to the opening link can be constituted by three components, i.e., the active lever, the spring, and the open link. Therefore, compared to the device according to the related art (the vehicle door lock device described in Japanese Patent Application Publication No. 2006-233507), the number of components can be reduced and the device can be constructed in a simple and inexpensive manner.

In practicing the present invention described above, a pushing leg portion may be provided in the lift lever and a receptor portion may be provided in the open link with the construction as described above. In this case, when the opened door, which is in the lock state by switching from the unlock position to the lock position of the active lever by the locking operation of the lock/unlock operation member, is closed without operation of the door handle, the pushing leg portion of the lift lever pushes the receptor portion of the open link. Accordingly, by means of such an operation, it is possible to move the open link from the locked state to the unlocked state and to move the active lever from the lock position to the unlock position. Therefore, in this case, by closing the door opened in the door-locked state, the door-locked state can automatically be canceled.

In this case, the operations described above can be achieved by disposing a plane of rotation of a main portion of the lift lever and a plane of tilting of a main portion of the open link in parallel with each other, by providing the pushing leg portion in the lift lever, and by providing the receptor portion in the open link. Thus, the foregoing canceling function can be performed without increase of the number of components. As a result, the construction can be achieved in a simple and inexpensive manner.

The vehicle door lock device in the present invention may comprises an outside open lever spring for biasing the outside open lever to the initial position. In this case, when the door, which is in the state where the active lever is held in the lock position by an external force and the outside open lever is in the initial position, is closed from its opened state, the outside open lever rotates in the direction of the operating position of the outside open lever against a biasing force of the outside open lever spring, along with tilting of the open link at the pushing arm portion. In this case, in a canceling operation in the state where the load beyond-assumption is imposed on the active lever, it is possible to prevent an overload on the lift lever and the open link, and thus to possible to prevent deformation of the lift lever and the open link. Moreover, size of the lift lever and the open link can be reduced.

In practicing the present invention described above, the pushing arm portion may be provided in the inside open lever and the receptor portion may be provided in the active lever with the construction as described above. In this case, the pushing arm portion of the inside open lever pushes the receptor portion of the active lever along with an actuation of the inside open lever to the door opening direction when the inside door handle is operated for opening the door which is closed and in the state where the active lever is in the lock position. By means of such an operation, it is possible to move the active lever from the lock position to the unlock position and to move the open link from the locked state to the unlocked state. Thus, in the door closed in the door-locked state, the door-locked state can automatically be canceled by the door opening operation of the inside door handle, and a so-called one-motion function or double pulling function (lock releasing function) is achieved.

In this case, the one-motion function or double pulling function as described above can be obtained by providing the pushing arm portion in the inside open lever and by providing the receptor portion in the active lever. Thus, this function can be added without increase of the number of components. As a result, the construction can be achieved in a simple and inexpensive manner.

In practicing the present invention described above, the open link may have an engaging arm portion capable of being engaged with and disengaged from the unlocked state holding guide. The unlocked state holding guide may have a guide surface for slidable engagement therewith of the engaging arm portion. The guide surface may have a curved surface corresponding to a moving path of the portion of engagement between the engaging portion of the lift lever and the pushing portion of the open link. In this case, the portion of engagement mentioned above may be made in a manner that slippage is suppressed.

In practicing the present invention described above, the unlocked state holding guide may be formed in the housing. Moreover, the locked state holding guide may be formed in the active lever. In these cases, the construction can be achieved in a simple manner without any new additional member.

In practicing the present invention described above, the open link may be set in a manner that, when a crash load is applied to the door, the open link in the unlocked state tilts into the locked state by an inertia force against the biasing force of the spring. In this case, even if the outside door handle should operate to open the door by an inertia force, the lift lever is never rotated by the open link. The door is thus held in a closed state (latched state) without opening, and it is possible to take a countermeasure against vehicle side crash in the vehicle door lock device.

DETAILED DESCRIPTION OF THE INVENTION

Figure 1:
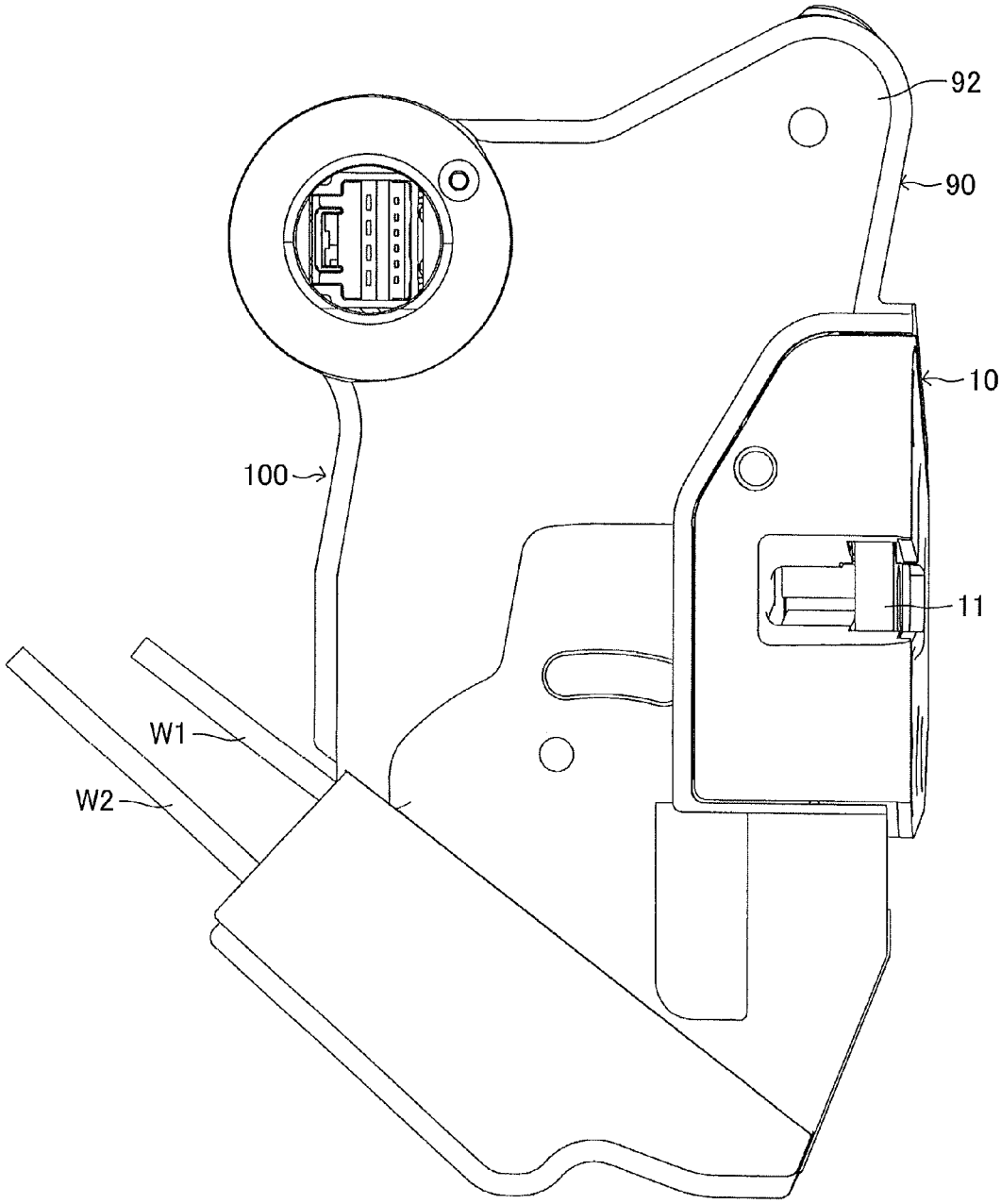
FIG. 1 is a side view of a vehicle door lock device according to an embodiment (door-unlocked state) of the present invention as seen from the inside of the vehicle.

An embodiment of the present invention will be described with reference to the drawings. FIGS. 1 to 12 illustrate a vehicle door lock device 100 according to the present invention. The vehicle door lock device 100 is attached to a door 201 (see FIG. 14) which is installed on a front right side of a vehicle. The door lock device 100 includes a latch mechanism 10, an inside open lever 21, and an outside open lever 22, as well as an open link 23, a spring 24, and an active lever 25. The door lock device 100 further includes an unlocked state holding guide 92*a* provided (formed) in a cover 92 of a housing 90. Further, the door lock device 100 includes a locked state holding guide 25*a* and a pushing arm portion 25*c* both provided (formed) in the active lever 25.

The latch mechanism 10 holds the door 201 in a closed state with respect to a body 202 (a vehicle body shown in FIG. 14) as known well. The latch mechanism 10 is mounted to the housing 90 provided with a body 91 and the cover 92, and is further mounted to the door 201, together with the housing 90. The latch mechanism 10 includes a latch 11 (see FIG. 1) capable of being engaged with and disengaged from a striker 203 (see FIG. 14) fixed to the body 202, a pole (not shown) capable of being engaged with and disengaged from the latch 11 as well as capable of maintaining and releasing the engagement of the latch 11 with the striker 203, and a lift lever 12 integral with the pole (not shown).

Figure 4:
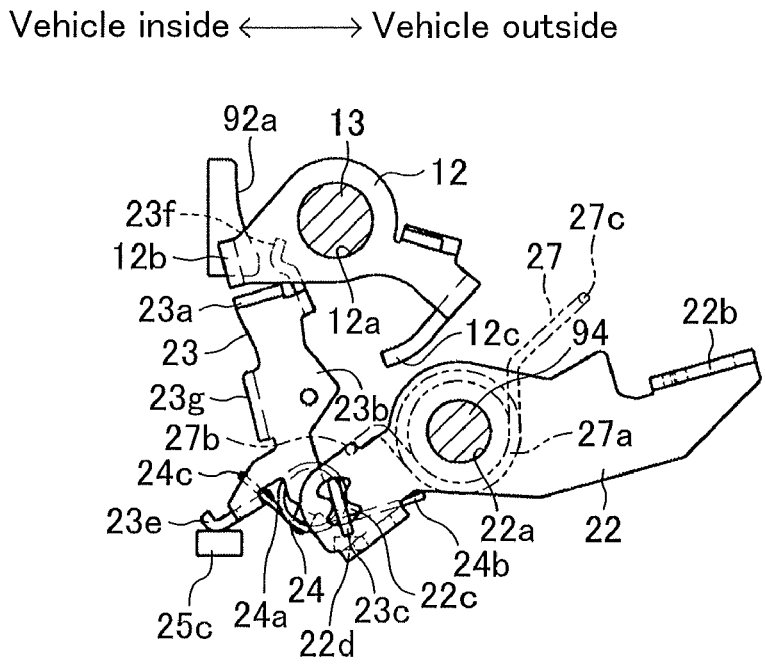
FIG. 4 is a diagram showing a relation in a vehicle width direction of an outside open lever, a spring, an open link, an active lever, and a lift lever, which are shown in FIG. 3, with respect to an unlocked state holding guide provided in a housing cover.

As shown in FIG. 4, the lift lever 12 is mounted integrally with a rotating shaft 13 of the pole (not shown) in a mounting hole 12*a* and rotates integrally with the pole (not shown). The lift lever 12 includes an engaging arm portion 12*b* capable of being engaged with and disengaged from a pushing head portion 23*a* of the open link 23, and a pushing leg portion 12*c* capable of being engaged with and disengaged from a receptor body 23*b* of the open link 23. A plane of rotation of a main portion (the portion fitted on the rotating shaft 13) of the lift lever 12 is approximately parallel to the paper surface of FIG. 4.

In the latch mechanism 10, the latch 11 engages with and disengages from the striker 203. By maintaining the engagement with the striker 203, the door 201 is held in a closed state (latched state). By disengaging from the striker 203, the door 201 moves from the closed state to an open state (unlatched state).

Figure 2:
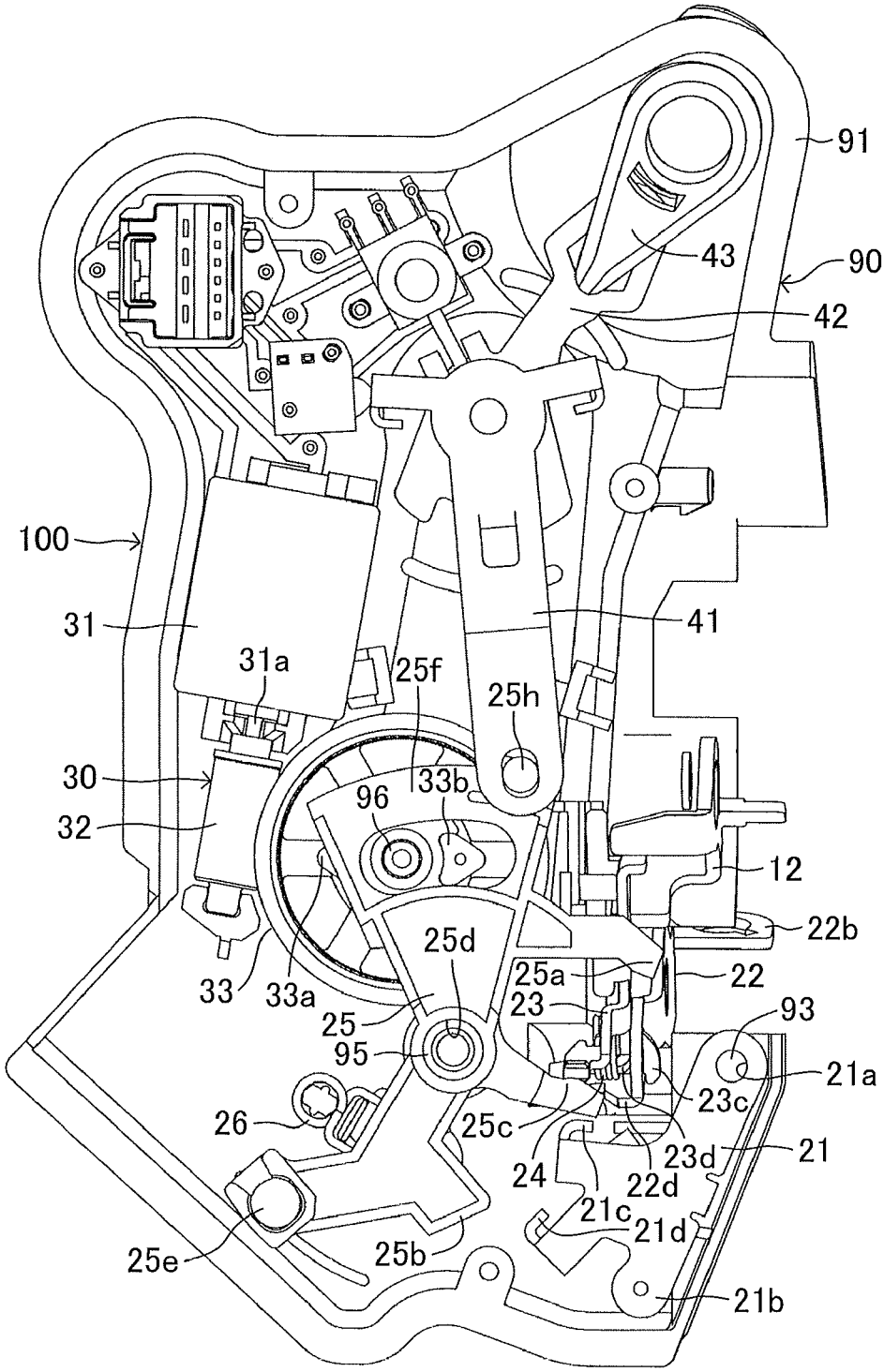
FIG. 2 is a side view of the vehicle door lock device shown in FIG. 1, without a latch mechanism other than a lift lever, and a housing cover.
Figure 3:
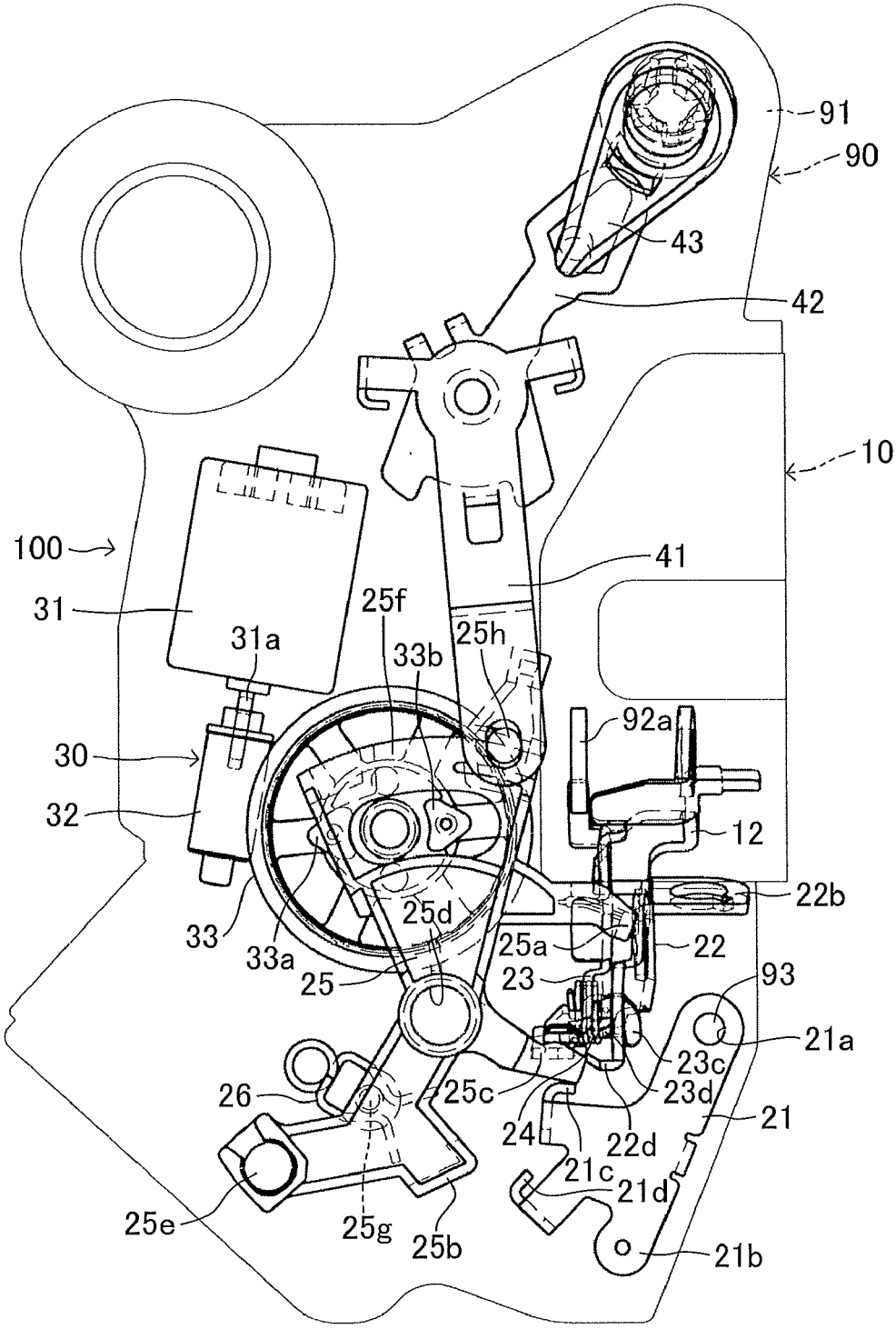
FIG. 3 is a side view showing in detail main constituent members of the vehicle door lock device shown in FIG. 2.

The inside open lever 21 is actuated for rotation from an initial position (a return position shown in FIGS. 2, 3, and 6) to an operating position (the position shown in FIG. 9) along with a door opening operation of an inside door handle 204 (see FIG. 14) provided inside the door 201. As shown in FIGS. 2 and 3, the inside open lever 21 is rotatably mounted to the housing 90 through a support shaft 93 in a support hole 21*a*. The inside open lever 21 includes an operation arm portion 21*b* which is associated with the inside door handle 204 through an operation cable W1 (an operation force transfer member such as a link is also acceptable) shown in FIG. 1, a first pushing arm portion 21*c* capable of being engaged with and disengaged from an engaging arm portion 22*d* of the outside open lever 22, and a second pushing arm portion 21*d* capable of being engaged with and disengaged from a receptor portion 25*b* of the active lever 25.

The outside open lever 22 is actuated for rotation from an initial position (a return position shown in FIGS. 4, 7, and 11) to an operating position (the position shown in FIGS. 5, 8, 10, and 12) along with a door opening operation of an outside door handle 205 (see FIG. 14) provided outside the door 201. The outside open lever 22 is rotatably mounted to the housing 90 through a support shaft 94 in a support hole 22*a*. The support hole 22*a* is formed so as to approximately be orthogonal to the support hole 21*a* of the inside open lever 21. The outside open lever 22 includes an operating portion 22*b*, connecting hole portion (a connecting portion) 22*c*, and an engaging arm 22*d*. The operating portion 22*b* is associated with the outside door handle 205 through an operation force transfer member such as a link (not shown). The connecting hole portion 22*c* is connected with the open link 23. The engaging arm portion 22*d* is capable of being engaged with and disengaged from the first pushing arm portion 21*c* of the inside open lever 21.

The outside open lever 22 is biased toward its initial position by an outside open lever spring 27. The outside open lever spring 27 biases the outside open lever 22 toward the initial position (the position shown in FIG. 4) with respect to the housing 90 with a predetermined biasing force. The outside open lever spring 27 includes a coil portion 27*a* mounted to the housing 90 through the support shaft 94 and a pair of arm portions 27*b* and 27*c* extending radially outwards respectively from ends of the coil portion 27*a*. The outside open lever spring 27 is engaged with the outside open lever 22 at one arm portion 27*b* and is engaged with the housing 90 at the other arm portion 27*c*.

The open link 23 includes the pushing head portion 23*a* and the receptor body 23*b* both mentioned above. The open link 23 further includes a connecting leg portion 23*c* and a support portion 23*d* (see FIGS. 2 and 3). The open link 23 is mounted to the connecting hole portion (connecting portion) 22*c* of the outside open lever 22 at the connecting leg portion 23*c* so as to be capable of tilting by a predetermined degree in the right and left direction in FIG. 4. The open link 23 supports the spring 24 at the support portion 23*d*. A plane of tilting of a main portion (e.g., the pushing head portion 23*a* and the receptor body 23*b*) of the open link 23 is approximately parallel to the paper surface of FIG. 4 and is disposed in parallel to a plane of rotation of the main portion of the lift lever 12. The open link 23 includes an engaging leg portion 23*e* capable of being engaged with and disengaged from a pushing arm portion 25*c* of the active lever 25, an engaging arm portion 23*f* capable of being engaged with and disengaged from the unlocked state holding guide 92*a* of the housing 90, and an engaging body 23*g* capable of being engaged with and disengaged from a locked state holding guide 25*a* (see FIGS. 7 and 8) of the active lever 25.

Figure 5:
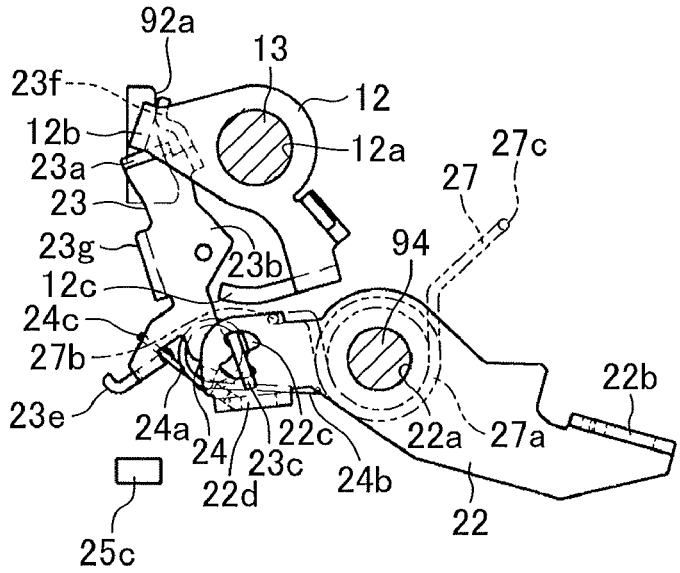
FIG. 5 is an operation explanation diagram in the state where the outside open lever has operated in a door opening direction in the construction shown in FIG. 4.

The open link 23 is constructed so as to be pushed from an initial position shown in FIG. 4 toward the lift lever 12 to move to an operating position shown in FIG. 5, when the inside open lever 21 is actuated for rotation from the initial position to the operating position or when the outside open lever 22 is actuated for rotation from the initial position to the operating position. Further, the open link 23 is constructed so as to be switched to an unlocked state (the state shown in FIG. 4) when the active lever 25 moves from a lock position (the position shown in FIG. 6) to an unlock position (the position shown in FIGS. 2 and 3), and switched to a locked state (the state shown in FIG. 7) when the active lever 25 moves from the unlock position to the lock position.

Figure 7:
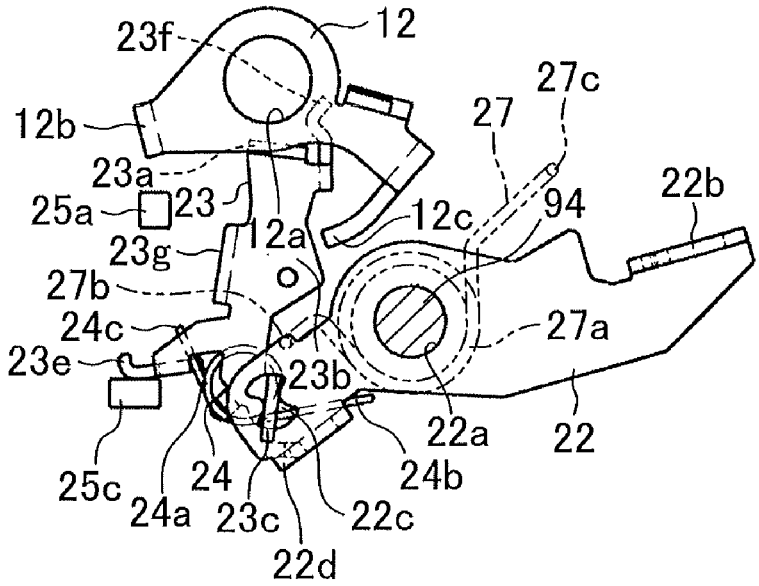
FIG. 7 is a diagram showing a relation in the vehicle width direction of the outside open lever, spring, open link, active lever, and lift lever shown in FIG. 6 with respect to a locked state holding guide provided in the active lever.
Figure 8:
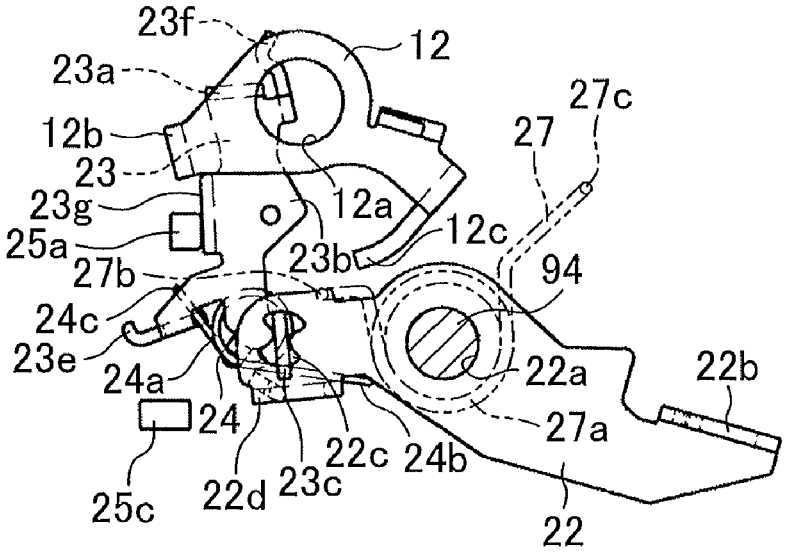
FIG. 8 is an operation explanation diagram in the state where the outside open lever has operated in the door opening direction in the construction shown in FIG. 7.
Figure 9:
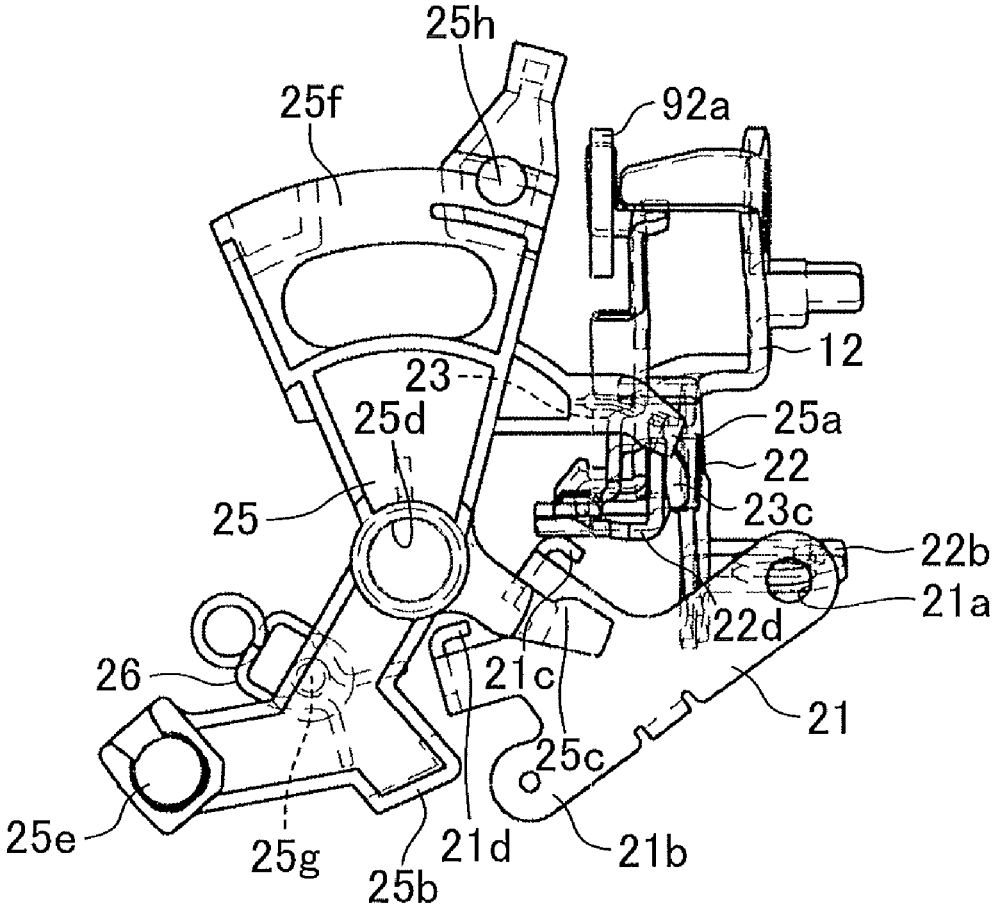
FIG. 9 is an operation explanation diagram for explaining a one-motion function of the vehicle door lock device shown in FIGS. 1 to 8.

When the open link 23 is in the unlocked state, the operations in the door opening direction of the open levers 21 and 22, which are performed along with the door opening operations of the door handles 204 and 205, are transmitted to the lift lever 12 through the open link 23, as shown in FIGS. 4 and 5. On the other hand, when the open link 23 is in the locked state, the operations in the door opening direction of the open levers 21 and 22, which are performed along with the door opening operations of the door handles 204 and 205, are transmitted to the open link 23, as shown in FIGS. 7 and 8, but are not transmitted from the open link 23 to the lift lever 12.

The spring 24 is interposed between the outside open lever 22 and the open link 23 and biases the open link 23 toward the unlocked state (the state shown in FIG. 4) against the outside open lever 22. The spring 24 includes a coil portion 24*a* mounted to the support portion 23*d* of the open link 23 and a pair of arm portions 24*b* and 24*c* extending radially outwards respectively from ends of the coil portion 24*a*. At one arm portion 24*b*, the spring 24 engages with the outside open lever 22, and at the other arm portion 24*c*, the spring 24 engages with the open link 23.

Figure 10:
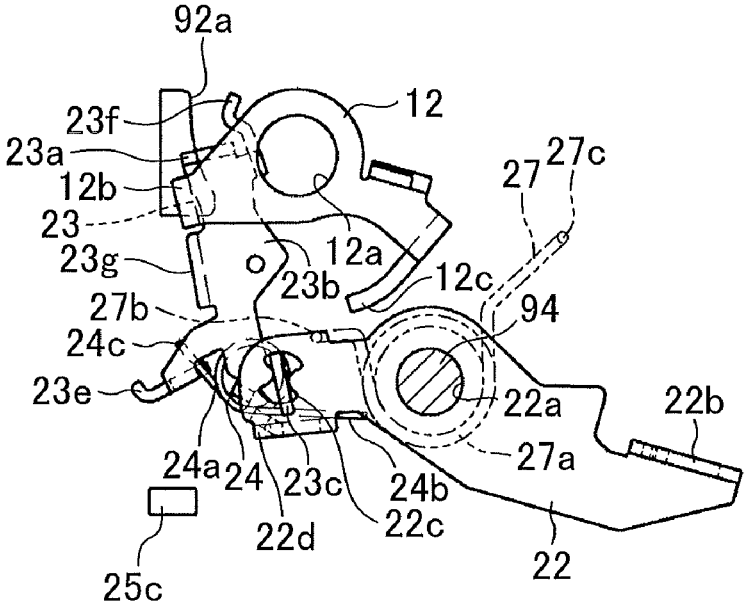
FIG. 10 is an operation explanation diagram for explaining a panic state (a state where the outside open lever shown in FIG. 7 operates in the door opening direction, the active lever shown in FIG. 7 moves toward an unlock position, and the open link is engaged with the lift lever) of the vehicle door lock device shown in FIGS. 1 to 8.
Figure 14:
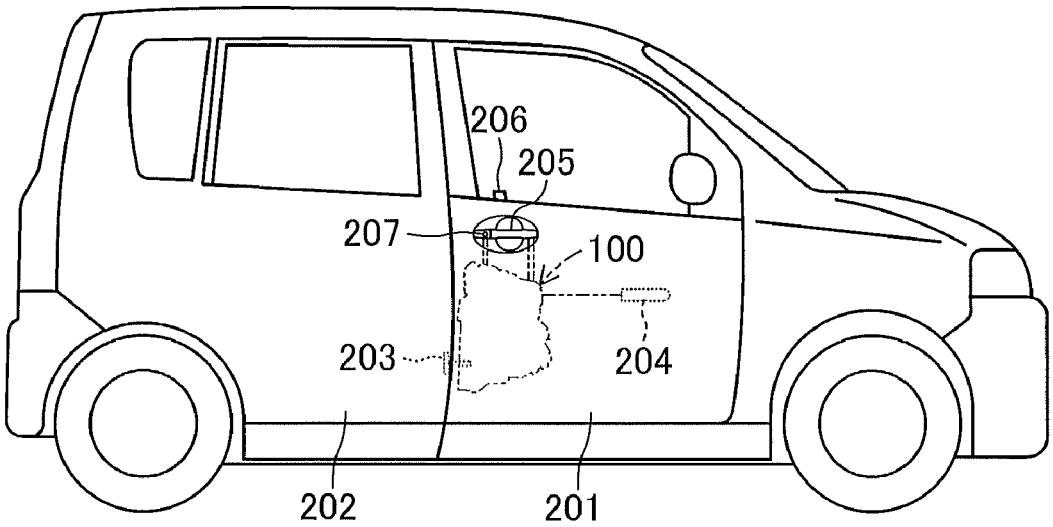
FIG. 14 is a right side view of a vehicle including the vehicle door lock device shown in FIGS. 1 to 13.

In the door-locked state (in a state where the door is locked), when the door handles 204, 205 shown in FIG. 14, and a lock/unlock operation member (e.g., a locking knob 206 provided inside the door 201, a key cylinder 207 operable from the outside of the door 201, or a remote control for operating an electric motor 31 in a drive mechanism 30) are operated at a time, a panic state occurs (see FIG. 10). When the vehicle door lock device 100 is in the panic state, by the function of the spring 24, the open link 23 is biased toward the unlocked state to be held elastically and movably relatively with respect to the engaging arm portion 12*b* of the lift lever 12, to permit return of the open link 23 to the initial position shown in FIG. 4.

Figure 6:
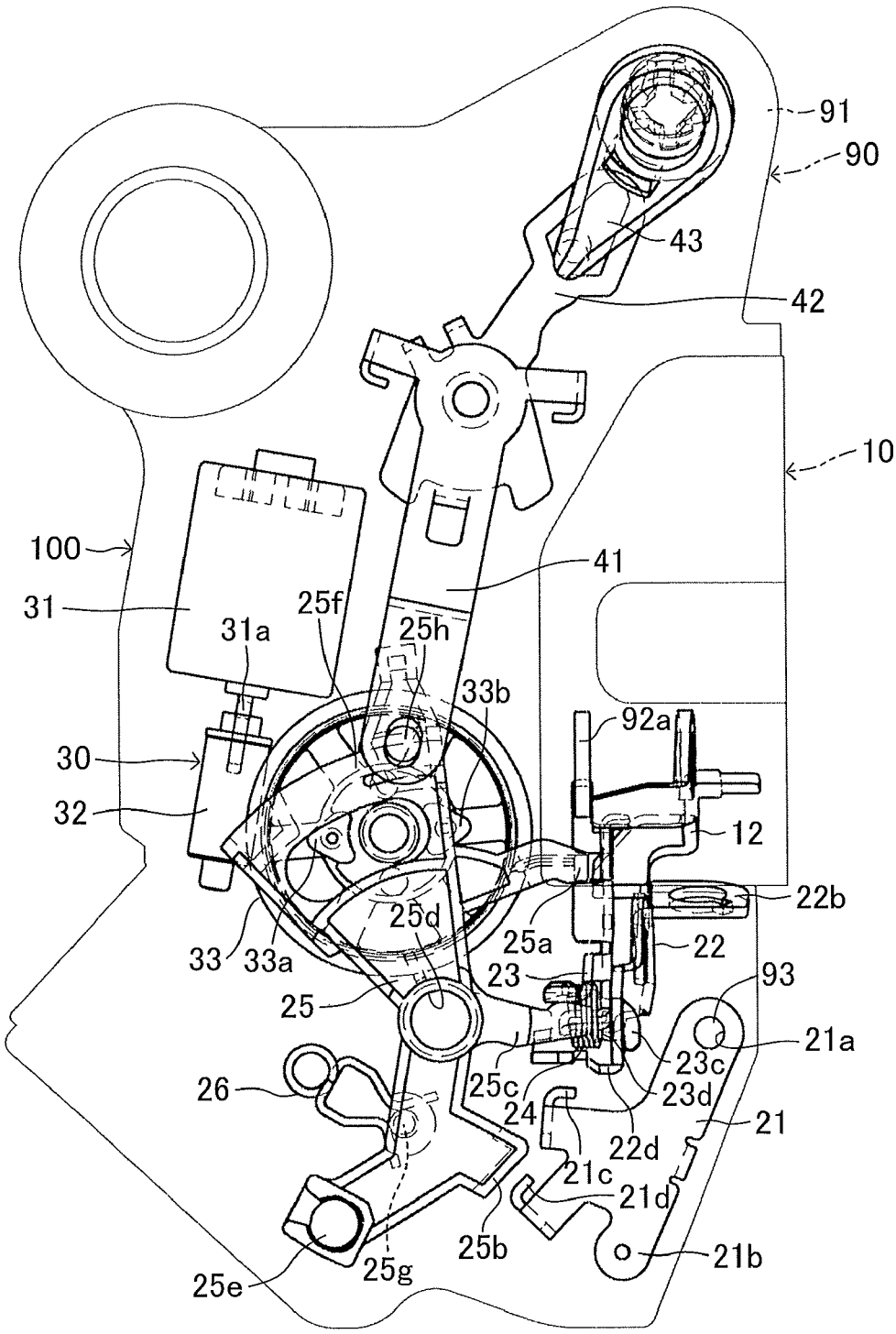
FIG. 6 is a side view corresponding to FIG. 3 in a door locked state of the vehicle door lock device shown in FIGS. 1 to 3.

The active lever 25 is switched from the unlock position shown in FIGS. 2 and 3 to the lock position shown in FIG. 6 by a locking operation of the lock/unlock operation member, to bring the open link 23 into the locked state. While, the active lever 25 is switched from the lock position to the unlock position by an unlocking operation of the lock/unlock operation member, to bring the open link 23 into the unlocked state. The active lever 25 is rotatably mounted to the housing 90 through a support shaft 95 at a support hole 25*d* formed in a boss portion of the active lever 25.

The active lever 25 includes the locked state holding guide 25*a*, receptor portion 25*b*, pushing arm portion 25*c*, and support hole 25*d* mentioned above. The active lever 25 further includes an operating portion 25*e* which is connected through an operation cable W2 shown in FIG. 1 to the locking knob 206 provided inside the door 201, a drive portion 25*f* associated with the drive mechanism 30, an engaging pin portion 25*g* (see FIG. 3) associated with a positioning spring 26, and an engaging pin portion 25*h* which is associated through a locking control lever 41, a key switch lever 42, and an outside locking lever 43 with the key cylinder 207 provided outside the door 201.

The active lever 25 is constructed so as to be held at the unlock position or the lock position by the positioning spring 26 mounted within the housing 90 and engaged with the engaging pin portion 25*g* (see FIG. 3) provided in the active lever 25. A holding force (a force for holding the active lever 25 at the lock position) of the spring 26 is set larger than the biasing force (the force for biasing the outside open lever 22 toward the initial position) of the outside open lever spring 27. In the door-locked state, therefore, the outside open lever 22, the open link 23, and the active lever 25 are held in their states shown in FIG. 7.

When the active lever 25 is in the unlock position shown in FIGS. 3 and 4 and the open link 23 is in the unlocked state, the pushing arm portion 25*c* engages with the engaging leg portion 23*e* of the open link 23 to tilt the open link 23 by switching of the active lever 25 from the unlock position (the position shown in FIG. 4) to the lock position (the position shown in FIG. 7). While, when the active lever 25 is in the lock position shown in FIGS. 6 and 7 and the open link 23 is in the locked state, the pushing arm portion 25*c* is capable of being disengaged from the open link 23 to permit movement of the open link 23 into the unlocked state.

The drive mechanism 30 actuates the active lever 25 to the lock position or the unlock position. The drive mechanism 30 includes an electric motor 31, a worm 32, and a worm wheel 33. The electric motor 31 is constructed by a known motor, which drives in response to a locking operation and an unlocking operation both performed by a lock/unlock operation member such as a remote control. The worm 32 is integrally provided on an output shaft 31*a* of the electric motor 31 and is actuated for rotation by the electric motor 31. The worm wheel 33 is actuated for rotation by the worm 32. The worm wheel 33 is rotatably mounted to the housing 90 through a support shaft 96. The worm wheel 33 is provided with a pair of cams 33*a* and 33*b* associated with a pair of cam followers (indicated by broken lines in FIG. 3 but a detailed description thereof is omitted) which are provided in the drive portion 25*f* of the active lever 25.

In the case where the lock/unlock operation member (e.g., a remote control for operating the electric motor 31) is operated to lock when the active lever 25 is in the unlock position shown in FIGS. 2 and 3, the worm wheel 33 is actuated for rotation by 180° in the counterclockwise direction through the worm 32 by the electric motor 31 and the active lever 25 moves to the lock position shown in FIG. 6. In the case where the lock/unlock operation member is operated to unlock when the active lever 25 is in the lock position shown in FIG. 6, the worm wheel 33 is actuated for rotation by 180° in the clockwise direction through the worm 32 by the electric motor 31 and the active lever 25 moves to the unlock position shown in FIGS. 2 and 3.

In this embodiment, as shown in FIGS. 3, 4, and 5, when the active lever 25 is in the unlock position and the outside open lever 22 rotates between the initial position and the operating position, the unlocked state holding guide 92*a* provided in the cover 92 of the housing 90 holds the open link 23 spaced away from the pushing arm portion 25*c* of the active lever 25 in the unlocked state. While the unlocked state holding guide 92*a* holds the open link 23 in the unlocked state, the engaging arm portion 23*f* of the open link 23 is in slidable engagement with the unlocked state holding guide 92*a* as shown in FIG. 5. The shape of the guide surface (the surface with which the engaging arm portion 23*f* comes into slidable engagement) of the unlocked state holding guide 92*a* is set as a curved surface, considering the moving path of the portion of engagement between the engaging arm portion 12*b* of the lift lever 12 and the pushing head portion 23*a* of the open link 23, to suppress slippage in the portion of engagement mentioned above.

On the other hand, as shown in FIGS. 6, 7 and 8, when the active lever 25 is in the lock position and the outside open lever 22 rotates between the initial position and the operating position, the locked state holding guide 25*a* provided in the active lever 25 holds the open link 23 spaced away from the pushing arm portion 25*c* of the active lever 25 in the locked state. While the locked state holding guide 25*a* holds the open link 23 in the locked state, the engaging body 23*g* of the open link 23 is in slidable engagement with the locked state holding guide 25*a*, as shown in FIG. 8.

In this embodiment, as shown in FIG. 7, the lift lever 12 is disposed in a manner that its pushing leg portion 12*c* is capable of pushing the receptor body 23*b* of the open link 23, when the opened door 201 is closed (at this time, as known well, the rotating shaft 13 of the pole is temporarily rotated by a predetermined degree in the clockwise direction in FIG. 7 together with the lift lever 12) in the state that the active lever 25 is in the lock position and the outside open lever 22 is in the initial position. Further, as shown in FIG. 6, the inside open lever 21 is disposed in a manner that its second pushing arm portion 21*d* is capable of pushing the receptor portion 25*b* of the active lever 25, when the inside door handle 204 is operated to open the door under in the state that the active lever 25 is in the lock position and the inside open lever 21 is in the initial position.

In this embodiment, when the inside door handle 204 is operated to open the door, the timing of engagement of the second pushing arm portion 21*d* of the inside open lever 21 with the receptor portion 25*b* of the active lever 25 is set earlier by a predetermined period than the timing of engagement of the first pushing arm portion 21 c of the inside open lever 21 with the engaging arm portion 22*d* of the outside open lever 22, to achieve a so-called one-motion function.

In the vehicle door lock device 100 of the embodiment constructed as described above, the constituent members operate in the manner to be described below (a) when the inside door handle 204 is operated to open the door which is in the door-unlocked state (in a state where the door 201 is unlocked), (b) when the outside door handle 205 is operated to open the door which is in the door-unlocked state, (c) when the outside door handle 205 is operated to open the door which is in the door-locked state (in a state where the door is locked), (d) when the inside door handle 204 is operated to open the door which is in the door-locked state, (e) when the door 201 which is in the door-locked state is closed without operating the door handles 204, 205, (f) when the door 201 which is in the door-locked state is closed with operating the outside door handle 205 to open the door, and (g) when the door 201 which is in the door-locked state is closed without operating the door handles 204, 205, while the locking knob 206 is fasten in the locked state with hand for example.

[(a) Operation Performed When the Inside Door Handle 204 is Operated to Open the Door Which is in the Door-unlocked State]

When the inside open lever 21 operates in the door opening direction (in the clockwise direction in FIGS. 2 and 3) along with the door opening operation of the inside door handle 204 of the closed door 201 which the vehicle door lock device 100 is in the door-unlocked state as shown in FIGS. 1 to 4, the open link 23 in the unlocked state is moved from the initial position (position shown in FIG. 4) to the operating position shown in FIG. 5 by the outside open lever 22 pushed by the inside open lever 21, as shown in FIGS. 4 and 5, and then the lift lever 12 rotates in the unlatching direction (in the clockwise direction of FIG. 4). Thus, the door opening operation of the inside open lever 21 is transmitted to the lift lever 12 through both outside open lever 22 and open link 23, so that the lift lever 12 rotates in an unlatching direction and the latch mechanism 10 comes into an unlatched state from a latched state, and thus the door 201 can be opened.

[(b) Operation Performed When the Outside Door Handle 205 is Operated to Open the Door Which is in the Door-unlocked State]

When the outside open lever 22 operates in the door opening direction (in the clockwise direction in FIG. 4) along with the door opening operation of the outside door handle 205 of the closed door 201 which the vehicle door lock device 100 is in the door-locked state as shown in FIGS. 1 to 4; the open link 23 in the unlocked state is moved from the initial position (the position shown in FIG. 4) to the operating position shown in FIG. 5 by the outside open lever 22 as shown in FIGS. 4 and 5, and then the lift lever 12 rotates in the unlatching direction. Thus, the door opening operation of the outside open lever 22 is transmitted to the lift lever 12 through the open link 23, and the lift lever 12 rotates in the unlatching direction, so that the latch mechanism 10 comes into the unlatched state from the latched state, and thus the door 201 can be opened.

[(c) Operation Performed When the Outside Door Handle 205 is Operated to Open the Door Which is in the Door-locked State]

When the outside open lever 22 operates in the door opening direction along with the door opening operation of the outside door handle 205 of the closed door 201 which the vehicle door lock device 100 is in the door-locked state as shown in FIGS. 6 and 7, the open link 23 in the locked state shown in FIG. 7 is lifted while being guided by the locked state holding guide 25*a* provided in the active lever 25 without being engaged with the lift lever 12 shown in FIG. 8. Thus, the door opening operation of the outside open lever 22 is not transmitted to the lift lever 12, so that the lift lever 12 does not rotate, and the latch mechanism 10 is maintained in the latched state. The door 201 cannot be opened.

[(d) Operation Performed When the Inside Door Handle 204 is Operated to Open the Door Which is in the Door-locked State]

On the other hand, when the inside open lever 21 operates in the door opening direction along with the door opening operation of the inside door handle 204 of the closed door 201 which the vehicle door lock device 100 is in the door-locked state as shown in FIGS. 6 and 7, the timing of engagement of the second pushing arm portion 21*d* of the inside open lever 21 with the receptor portion 25*b* of the active lever 25 is earlier by a predetermined period than the timing of engagement of the first pushing arm portion 21*c* of the inside open lever 21 with the engaging arm portion 22*d* of the outside open lever 22. Up to when the first pushing arm portion 21*c* of the inside open lever 21 engages with the engaging arm portion 22*d* of the outside open lever 22, the open link 23 in the locked state shown in FIG. 7 has already been moved to the unlocked state shown in FIG. 4. Thus, thereafter, the similar operation to the above-described operation (a) is achieved, and the door 201 can be opened. A so-called one-motion function (a function to open the door 201 in the door-locked state with a single door opening operation) can be achieved by the operation (d).

[(e) Operation Performed When the Door 201 Which is in the Door-locked State is Closed Without Operating the Door Handles 204, 205 (Canceling Operation)]

In this embodiment, the pushing leg portion 12*c* is provided in the lift lever 12 of the vehicle door lock device 100 and the receptor body 23*b* is provided in the open link 23. In this operation, at first, the door 201 is opened and the vehicle door lock device 100 is brought into the door-locked state as shown in FIGS. 6 and 7 by, for example, the opening operation of the locking knob 206. And then, the opened door 201 is closed without operating the door handles 204 and 205 in this state (a state where a large load is not imposed on the canceling system of the lift lever 12 to the active lever 25, e.g., in a state where the locking knob 206 is not held in the locked state with hand). Then, as known well, the latch 11 in the latch mechanism 10 comes into engagement with the striker (not shown), and the rotating shaft 13 of the pole temporarily rotates by a predetermined degree in the clockwise direction in FIG. 7 together with the lift lever 12 and thereafter reverts to the original state. Thus, at the time when the door 201 is closed, the pushing leg portion 12*c* of the lift lever 12 shown in FIG. 7 operates to push the receptor body 23*b* of the open link 23.

Figure 11:
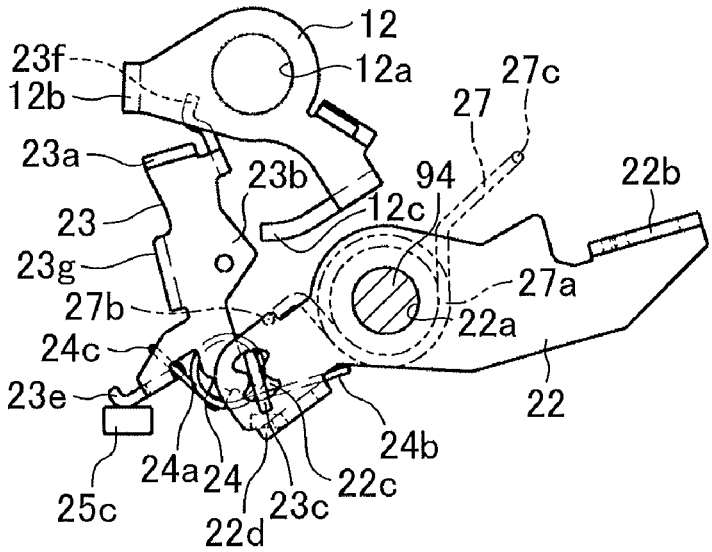
FIG. 11 is an operation explanation diagram for explaining a canceling function of the vehicle door lock device shown in FIGS. 1 to 8.
Figure 12:
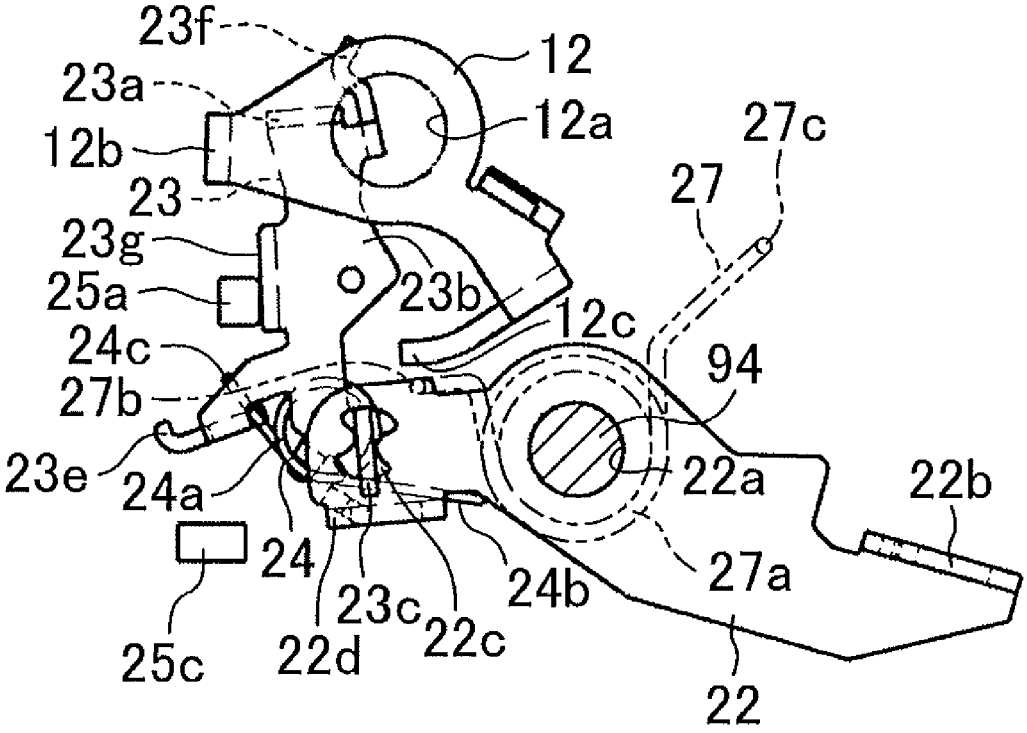
FIG. 12 is an operation explanation diagram for explaining a keyless locking function of the vehicle door lock device shown in FIGS. 1 to 8.

As a result, the open link 23 and the pushing arm portion 25*c* of the active lever 25 are moved from the locked state shown in FIG. 7 to the unlocked state shown in FIG. 11, and then the door locked state is automatically canceled. Thus, an unlocking operation is obtained by closing the door 201 in the door-locked state from its opened state, and the door-locked state shown in FIGS. 6 and 7 comes into the door-unlocked state shown in FIGS. 1 to 4 and 11. By the canceling operation described above, a key confinement can be prevented.

[(f) Operation Performed When the Door Which is in the Door-locked State is Closed With Operating the Outside Door Handle 205 to Open the Door]

The unlocking actuation by the door closing operation described in the above (e) can be canceled out by operating the outside door handle 205 to open the door when the door 201 which is in the door-locked state by locking operation of the locking knob 206 is closed as shown in FIGS. 6 and 7. In this case, the state of the door lock device 100 is shifted from the state shown in FIG. 7 to the state shown in FIG. 12 (that is, the pushing leg portion 12*c* of the lift lever 12 performs an air-fanning actuation for the open link 23 when the rotating shaft 13 of the pole temporarily rotates by a predetermined degree together with the lift lever 12 and thereafter reverts to the original state at the time of closing the door 201). Thus the open link 23 is maintained in the locked state and the active lever 25 is maintained in the lock position. By returning the outside door handle 205 to the original state, the state of the outside open lever 22, open link 23, and spring 24 shown in FIG. 12 revert to the states shown in FIG. 7, and the door-locked state is maintained. As a result, keyless lock can be achieved.

[(g) Operation Performed When the Door 201 Which is in the Door-locked State is Closed Without Operating the Door Handles 204, 205, While the Locking Knob 206 is Fasten in the Locked State With Hand for Example (Invalid Cancelling Operation)]

In this embodiment, the pushing leg portion 12*c* is provided in the lift lever 12 of the vehicle door lock device 100, and the receptor body 23*b* is provided in the open link 23. The open link 23 is capable of tilting leftwards in FIG. 7 over the pushing arm portion 25*c* of the active lever 25, and the outside open lever 22 rotates in the clockwise direction in FIG. 7 along with the tilting motion of the open link 23. In this operation, at first, the locking knob 206 is operated to set the door-locked state while the door 201 is opened as shown in FIGS. 6 and 7. And then the door 201 is closed without operating the door handles 204 and 205 in the state where the locking knob 206 is held in the locked state with hand (a state where a large load is imposed on the canceling system of the lift lever 12 to the active lever 25). Then, similarly to the above-described operation (e), the latch 11 in the latch mechanism 10, as known well, comes into engagement with the striker (not shown), the rotating shaft 13 of the pole temporarily rotates by a predetermined degree in the clockwise direction in FIG. 7 together with the lift lever 12, and then the rotating shaft 13 reverts to the original state. Therefore, at the time when the door 201 is closed, the pushing leg portion 12*c* of the lift lever 12 shown in FIG. 7 operates to push the receptor body 23*b* of the open link 23.

Figure 13:
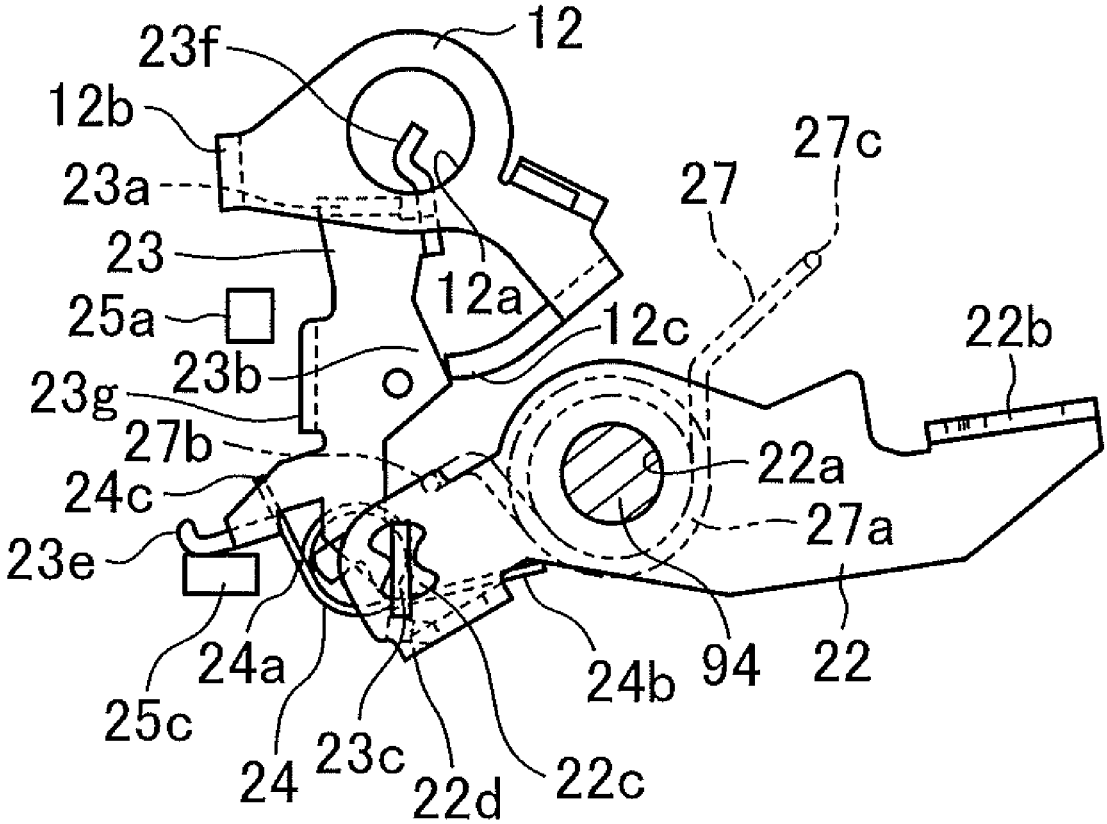
FIG. 13 is an operation explanation diagram for explaining invalid cancel of the vehicle door lock device shown in FIGS. 1 to 8.

At this time, however, the locking knob 206 is held in the locked state with hand, and thus, when the pushing leg portion 12*c* of the lift lever 12 pushes the receptor body 23*b* of the open link 23, the pushing arm portion 25*c* of the active lever 25 does not move downwards (the door-unlock position shown in FIG. 4). In this case, the open link 23 tilts from the position shown in FIG. 7 to the position shown in FIG. 13 over the pushing arm portion 25*c* of the active lever 25, and along with this tilting motion of the open link 23, the outside open lever 22 rotates from the position shown in FIG. 7 to the position shown in FIG. 13 against the biasing force of the outside open lever spring 27. As a result, an input load from the lift lever 12 can be allowed to escape through the above-described tilting motion of the open link 23 and rotation of the outside open lever 22. Therefore, in a canceling operation in the state where a load beyond-assumption is applied to the active lever 25, it is possible to prevent an overload on the lift lever 12 and the open link 23, and thus possible to prevent deformation of the lift lever 12 and the open link 23. Moreover, size of the lift lever 12 and the open link 23 can be reduced.

In the vehicle door lock device 100 according to the embodiment described above, the spring 24 interposed between the outside open lever 22 and the open link 23 biases the open link 23 toward the unlocked state and causes the open link 23 to be held movably relatively with respect to the lift lever 12 so as to permit return of the open link 23 to the initial position. Further, the pushing arm portion 25*c* of the active lever 25 is disengageable from the open link 23 so as to permit movement of the open link 23 in the locked state to the unlocked state. Accordingly, in the door-locked state (in the state where the door 201 is locked), if the door handles 204, 205, and the lock/unlock operation member are operated at a time and then a panic state occurs, the open link 23 is held movably relatively with respect to the lift lever 12 to permit return of the open link 23 to the initial position, as shown in FIG. 10. Thus, even in the panic state mentioned above, by restoring the outside open lever 22 to the initial position, the open link 23 reverts to the initial position while coming into the unlocked state. Therefore, smooth switching to the door-unlocked state (in a state where the door 201 is unlocked) can be achieved.

In the vehicle door lock device 100 according to this embodiment described above, at the time when a panic state mentioned above occurs, the spring 24 interposed between the outside open lever 22 and the open link 23 functions as described above, as shown in FIG. 10, so that it is not necessary to interpose a spring in the active lever 25 itself and thus the active lever 25 can be constituted by a single member. Accordingly, components from the active lever 25 to the open link 23 can be constituted by three components, i.e., the active lever 25, spring 24, and open link 23. Therefore, compared to the device according to the related art (the vehicle door lock device described in Japanese Patent Application Publication No. 2006-233507), it is possible to reduce the number of components and construct the device in a simple and inexpensive manner.

In the vehicle door lock device 100 according to this embodiment described above, as shown in FIG. 4, the pushing leg portion 12*c* is provided in the lift lever 12 and the receptor body 23*b* is provided in the open link 23. Thus, when the active lever 25 is switched from the unlock position to the lock position to bring the vehicle door lock device 100 into the door-locked state by the locking operation of the lock/unlock operation member while the door 201 is open, and then closing the door 201 without operating the door handles 204 and 205; the pushing leg portion 12*c* of the lift lever 12 operates to push the receptor body 23*b* of the open link 23. Therefore, by utilizing such an operation, it is possible to move the open link 23 from the locked state to the unlocked state, and to move the active lever 25 from the lock position to the unlock position. In this case, therefore, by closing the door 201 in the locked state, the door-locked state can automatically be canceled.

In this case, the above operations can be achieved by disposing a plane of rotation of the main portion of the lift lever 12 and a plane of tilting of the main portion of the open link 23 in parallel with each other, by providing the pushing leg portion 12*c* in the lift lever 12, and by providing the receptor body 23*b* in the open link 23. Thus, the canceling function described above can be added without increasing the number of components. Therefore, the device can be constructed in a simple and inexpensive manner.

In the vehicle door lock device 100 according to the embodiment described above, as shown in FIGS. 2 and 3, the second pushing arm portion 21*d* is provided in the inside open lever 21 and the receptor portion 25*b* is provided in the active lever 25. Thus, if the inside door handle 204 is operated to open the door in the case where the door 201 is closed and the active lever 25 is in the lock position; the inside open lever 21 operates in the door opening direction and the second pushing arm 21*d* of the inside open lever 21 operates to push the receptor portion 25*b* of the active lever 25. Therefore, by utilizing such an operation, it is possible to move the active lever 25 from the lock position to the unlock position, to move the open link 23 from the locked state to the unlocked state. In this case, therefore, as to the door 201 closed in the locked state, the door locked state can automatically be released by the door opening operation of the inside door handle 204. Thus, a so-called one-motion function can be achieved.

In this case, the above-described operations can be achieved by providing the second pushing arm portion 21*d* in the inside open lever 21 and providing the receptor portion 25*b* in the active lever 25, and the one-motion function mentioned above can be added without increasing the number of components. Thus, the device can be constructed in a simple and inexpensive manner.

In the vehicle door lock device 100 according to the embodiment described above, the unlocked state holding guide 92*a* is provided in the cover 92 of the housing 90 (That is, the unlocked state holding guide 92*a* is formed in the housing 90). Moreover, the locked state holding guide 25*a* is provided in the active lever 25 (That is, the locked state holding guide 25*a* is formed in the active lever 25). Therefore, the unlocked state holding guide 92*a* and the locked state holding guide 25*a* can be constructed in a simple manner without adding any new member. In the housing 90, in the case where the body 91 and the cover 92 are disposed reversely inside and outside, the unlocked state holding guide 92*a* may be formed in the body 91 of the housing 90.

In the vehicle door lock device 100 according to this embodiment described above, the tilting directions of the open link 23 with respect to the outside open lever 22 are in the directions of vehicle inside and outside as shown in FIG. 4, and at the time when the vehicle is crashed from the vehicle outside of the door 201 toward the vehicle inside (side crash), the open link 23 undergoes an inertia force to tilt outwards of the vehicle with respect to the outside open lever 22. Therefore, even in the case where the open link 23 is in the unlocked state shown in FIG. 4 at the time of vehicle side crash , as long as the open link 23 is set to tilt quickly into the locked state shown in FIG. 7 against the biasing force of the spring 24 by means of the inertia force acting outwards of the vehicle on the opening link 23 at the time of vehicle side crash (for example, the setting may be performed in accordance with the plate thickness of the open link 23 or performed by attaching a separate weight to the open link 23), even if the outside door handle 205 provided outside the door 201 operates to open the door due to the inertia force induced at the time of vehicle side crash and the outside open lever 22 rotates as shown in FIG. 8, the lift lever 12 is never rotated by the open link 23. Therefore, the door 201 is held in the closed state (latched state) without opening and it is possible to take a countermeasure to vehicle side crash in the vehicle door lock device 100.

According to the embodiment described above, when the inside door handle 204 is operated to open the closed door 201 in the door-locked state, the timing of engagement of the second pushing arm portion 21*d* of the inside open lever 21 with the receptor portion 25*b* of the active lever 25 (a drive start timing of the active lever 25 toward the unlock position by the inside open lever 21) is set earlier by a predetermined period than the timing of engagement of the first pushing arm portion 21*c* of the inside open lever 21 with the engaging arm portion 22*d* of the outside open lever 22 (a drive start timing of the outside open lever 22 toward the operating position by the inside open lever 21), to achieve a one-motion function (a lock releasing function by a single pulling operation of the inside door handle 204). However, the drive start timing of the active lever 25 toward the unlock position by the inside open lever 21 may be set later by a predetermined period than the drive start timing of the outside open lever 22 toward the operating position by the inside open lever 21, to achieve a so-called double pulling function (a lock releasing function by a double pulling operation of the inside door handle 204).

Although the above embodiment has been constructed so as to achieve the canceling function and one-motion function described above, the construction so as not to afford those functions may be employed. Although, in the above embodiment, the present invention is applied to the vehicle door lock device 100 attached to the door 201 installed on the front right side of the vehicle, the present invention is also applicable in the similar way as described above, or by making appropriate changes, to a vehicle door lock device attached to a door installed on the front left side of the vehicle as well as a vehicle door lock device attached to a door installed on the rear right or left side of the vehicle.

The invention claimed is:

1. A vehicle door lock device, comprising:

a latch mechanism being capable of holding a door of a vehicle in a closed state with respect to a body of the vehicle and adapted to be mounted to said door together with a housing;

an inside open lever rotatably mounted to said housing and adapted to be actuated for rotation from an initial position to an operating position along with a door opening operation of an inside door handle provided inside said door;

an outside open lever rotatably mounted to said housing and adapted to be actuated for rotation from an initial position to an operating position along with a door opening operation of an outside door handle provided outside said door;

an open link tiltably mounted to a connecting portion provided in said outside open lever by a predetermined amount, said connecting portion being adapted to be displaced along with rotation of said outside open lever, said open link having a pushing portion capable of engaging an engaging portion of a lift lever provided in said latch mechanism, said open link being pushed from an initial position toward said lift lever when said inside open lever is actuated for rotation from the initial position to the operating position or when said outside open lever is actuated for rotation from the initial position to the operating position;

an active lever rotatably mounted to said housing and adapted to be switched by a locking operation of a lock/unlock operation member from an unlock position to a lock position to bring said open link into a locked state and switched by an unlocking operation of said lock/unlock operation member from the lock position to the unlock position to bring said open link into an unlocked state;

a spring interposed between said outside open lever and said open link, the spring biasing said open link toward the unlocked state and causing the open link to be held relatively movably with respect to said lift lever to permit return of the open link to the initial position;

an unlocked state holding guide for holding said open link in the unlocked state when said active lever is in the unlock position and when said outside open lever rotates between the initial position and the operating position, said unlocked state holding guide being configured so as to hold the open link in the unlocked state by preventing the open link from moving into the locked state through a frictional cooperation between the open link and the unlocked state holding guide;

a locked state holding guide for holding said open link in the locked state when said active lever is in the lock position and when said outside open lever rotates between the initial position and the operating position, said locked state holding guide being configured so as to hold the open link in the locked state by preventing the open link from moving into the unlocked state through a frictional cooperation between the open link and the locked state holding guide;

a pushing arm portion provided in said active lever, said pushing arm portion being configured such that when said active lever is in the unlock position, said pushing arm portion engages with said open link which is in the unlocked state so that said open link tilts by switching a position of said active lever from the unlock position to the lock position, and said pushing arm portion disengages from said open link which is in the locked state to permit the movement of the open link into the unlocked state;

a first pushing arm portion provided in said inside open lever, said first pushing arm portion capable of being engaged with and disengaged from said outside open lever; and a second pushing arm portion provided in said inside open lever, said second pushing arm portion capable of being engaged with and disengaged from said active lever;

wherein said first pushing arm portion and said second pushing arm portion are configured so that the timing of engagement of said second pushing arm portion with said active lever is earlier than the timing of engagement of said first pushing arm portion with said outside open lever when said inside door handle is operated to open the door.

2. A vehicle door lock device according to claim 1, wherein a plane of rotation of a main portion of said lift lever and a plane of tilting of a main portion of said open link are disposed in parallel with each other, a pushing leg portion is provided in said lift lever, a receptor portion is provided in said open link, and said lift lever is disposed in a manner that said pushing leg portion of the lift lever is capable of pushing said receptor portion of said open link when said door which is in the state where said active lever is in the lock position and said outside open lever is in the initial position is closed from its opened state.

3. A vehicle door lock device according to claim 2, further comprising an outside open lever spring for biasing said outside open lever to the initial position, and wherein said outside open lever rotates in the direction of the operating position of the outside open lever against a biasing force of the outside open lever spring, along with tilting of said open link at said pushing arm portion when said door, which is in the state where said active lever is held in the lock position by an external force and said outside open lever is in the initial position, is closed from its opened state.

4. A vehicle door lock device according to claim 1, wherein a pushing arm portion is provided in said inside open lever, a receptor portion is provided in said active lever, and said inside open lever is disposed in a manner such that said pushing arm portion thereof is capable of pushing said receptor portion of said active lever when said inside door handle is operated for opening said door which is closed and in the state where said active lever is in the lock position and said inside open lever is in the initial position.

5. A vehicle door lock device according to claim 1, wherein said open link has an engaging arm portion capable of being engaged with and disengaged from said unlocked state holding guide, and said unlocked state holding guide has a guide surface for slidable engagement therewith of said engaging arm portion, said guide surface having a curved surface shaped in a manner related to the direction of travel of the lift lever and the open link.

6. A vehicle door lock device according to claim 1, wherein said unlocked state holding guide is formed in said housing.

7. A vehicle door lock device according to claim 1, wherein said locked state holding guide is formed in said active lever.

8. A vehicle door lock device according to claim 1, wherein said open link is configured to tilt by inertia force against a biasing force of the spring when the open link is in the locked state and a crash load is applied to said door, thereby the position of said open link changes to the locked state.

* * * * *